US007374624B1

(12) United States Patent
Lacy

(10) Patent No.: US 7,374,624 B1
(45) Date of Patent: May 20, 2008

(54) VERTICAL PLATE DIP QUENCH

(76) Inventor: John Paul Lacy, P.O. Box 853, Baytown, TX (US) 77522

( * ) Notice: Subject to any disclaimer, the term of this patent is extended or adjusted under 35 U.S.C. 154(b) by 0 days.

(21) Appl. No.: 11/586,469

(22) Filed: Oct. 25, 2006

(51) Int. Cl.
*C21D 9/00* (2006.01)

(52) U.S. Cl. ..... 148/658; 148/131; 148/153; 148/157; 266/112; 266/117; 266/130

(58) Field of Classification Search ..... 148/658; 266/112, 102, 130, 131, 132, 133
See application file for complete search history.

(56) References Cited

U.S. PATENT DOCUMENTS

| | | | | |
|---|---|---|---|---|
| 141,837 | A | 8/1873 | Urban | |
| 2,586,042 | A * | 2/1952 | Hodge et al. | 420/91 |
| 3,420,083 | A | 1/1969 | Safford et al. | |
| 3,423,254 | A | 1/1969 | Safford et al. | |
| 3,546,911 | A | 12/1970 | Lenz | |
| 3,680,344 | A * | 8/1972 | Manthey et al. | 134/76 |
| 3,756,869 | A | 9/1973 | Melloy et al. | |
| 3,895,498 | A * | 7/1975 | Manthey et al. | 62/64 |
| 4,148,673 | A | 4/1979 | Lacy | |

OTHER PUBLICATIONS

Ref.J-LeClerc et al—"A New Equipment for the Accelerated Cooling or Direct Quenching on the Rolling Line for Plates Installed RAC at Dunkirk (France)" Preprint Internal Conference on Steel Rolling, The Iron and Steel Institute of Japan, Tokyo, Japan, Sep. 29 - Oct. 4, 1980, pp. 1321-1332. para 43.

Ref.K-Grossman—1952—"Effectiveness of Various Quenching Practices." Elements of Hardenability. ASM Cleveland.

* cited by examiner

*Primary Examiner*—Roy King
*Assistant Examiner*—Christopher Kessler
(74) *Attorney, Agent, or Firm*—Stephen S. Hodgson

(57) ABSTRACT

A method and apparatus for quenching steel plates after they come from an austenitizing furnace. The plates are rotated to a vertical orientation and rapidly submerged into a water bath while being held flat between reciprocating rolls. The superior uniformity and severity of the quench produces plates of commercial flatness and uniform mechanical properties throughout in an apparatus of simple construction and low energy consumption.

10 Claims, 7 Drawing Sheets

VERTICAL PLATE DIP QUENCH

CROSS-REFERENCE TO RELATED APPLICATIONS

Not Applicable

STATEMENT REGARDING FEDERALLY SPONSORED RESEARCH

Not Applicable

SEQUENCE LISTING OR PROGRAM

Not Applicable

BACKGROUND OF THE INVENTION

1. Field of Invention

This invention relates to an improved method and apparatus for quenching steel plates.

2. Description of the Related Art

Since the introduction to the construction industry by the steel producers of low carbon, heat treated, weldable, constructional alloy steel plates of high mechanical yield strengths and superior notch toughness, the most critical phase of the manufacturing process has been the water quenching of the plates during heat treatment.

Commercial steel quenched and tempered heat treated plates generally range in size from 20 to 50 feet long, 72 to 156 inches wide and 3/16 to 4 inches thick and in weight form ¼ to 50 tons.

The purpose of the quench is to cool a plate uniformly and sufficiently rapid, from a high temperature, usually 1650 degrees F., to obtain the optimum microstructure throughout the full thickness of the plate and to retain or improve the plate flatness as produced by the rolling mill. This operation is best explained by describing both the heat treating equipment originally used along with the modern day prior art equipment in terms of steel microstructures that are dependent upon the steel analysis, temperature and cooling rate in the quench.

The fundamental property of steel from which its response to heat treatment derives is the ability of steel to exist with its atoms arranged in two distinctly different crystallographic forms; one that is characteristic of steel at high temperature (above 1500 degrees F. for a 0.20% carbon steel); and one that is characteristic of steel at lower temperatures. The high temperature form is called austenite, and depending on its rate of cooling, will transform into either of two general categories of low temperature forms-lamellar or acicular. The acicular structure called martensite is a much stronger form of steel than the lamellar pearlite and is the microstructure desired when water quenching. The martensitic microstructure, after a tempering heat treatment, usually between 750 degrees F. and 1300 degrees F., results in a more optimum combination of strength, ductility and notch toughness than any of the known steel microstructures. Every analysis of steel has a minimum rate of cooling from the austenitic form that will result in a transformation to martensite. This rate is referred to as "Critical Cooling Rate." Alloy additions to steel lower this rate. During the quenching operation any portion of a plate that cools slower than its critical cooling rate will transform to the lower strength lamellar microstructure. Keeping in mind that the internal portions of a plate cool slower than the plate surface and in the case of a non-uniform quench the steel analysis must be designed with enough alloy content to compensate for the slowest cooling location. Such characteristics of the quenching apparatus as cooling severity and uniformity have dictated the alloy content for any plate thickness, and the maximum thickness of plate of any specific alloy that will result in complete transformation to martensite.

The original method of heat treating quench and temper plates was to heat the plate in a car bottom furnace, lift the hot plate from the car bottom by an overhead crane equipped with plate hooks attached to a spreader bar and submerge the plate held horizontally into a water bath. The plate hooks held only a small portion of the plate edges. Steam pockets formed on the bottom plate surface, creating uneven cooling between the top and bottom surfaces causing a high degree of plate distortion. Since all these plates required mechanical leveling their strength level, width and thickness were restricted to the flattening machines capabilities. A further restriction depended on the end use of the plate, as sheared or gas cut sections from a leveled plate distorted them to a degree proportional to the amount of cold work applied to the parent plate during leveling. The first efforts to improve upon this method employed for the plate supports was a series of C shaped hooks attached to a spreader bar that lifted a plate from the furnace car bottom and submerged it into a water dip tank. This device supported a plate across its entire width and allowed for the quenching of wider plates that would otherwise buckle when lifted by plate hooks. This method also created steam pockets on the bottom plate surface and resulted in the same degree of distortion as the plate hook method.

Plates quenched and tempered by this dip quench, primarily Protective Deck Plate and Special Treatment Steel for the U.S. Navy during the World War II period were highly alloyed with nickel and chromium and presented no metallurgical problems.

Shortly after the World War II period the United States Steel Corp. developed a low alloy, high strength, quench and temper steel characterized by good weldability and toughness for the construction industry. See Hodge et al U.S. Pat. No. 2,586,042. This steel was successfully dip quenched out of car bottom furnaces but also required extensive leveling. Other plate manufacturers followed suit and there was a strong need for a quenching process that produced a flat plate. These steels were and still are produced under the specification ASTM, A514, and A517.

The maintaining of plate flatness during the quenching operation had had a far greater influence upon the design of plate heat treating facilities than the quest for microstructure. In 1942, the Drever Co. of Bethayres, Pa., a furnace manufacturer, in concert with Dofasco, engineered the first plate pressure quench to create and manufacture the continuous plate heat treating concept. In operation, a plate would exit the furnace and move into the quench on conveyor rolls. Once the plate was in position the conveyor rolls would be hydraulically lowered, the plate coming to rest on the fingers (feet, jaws) of the lower platen, while at the same time, the upper platen would be lowered onto the plate. The platens are so designed to allow space for the spray pipes that extend across the width of the plate. Water sprays from the pipes then sprayed on the plate from above and below. Typical water flows for roller pressure spray quenches range from 14 to 25 GPM/sq. ft. on each side of the plate while pressures are about 15 psi. The restraining force provided by the platens was as high as 8500 lbs/sq. ft. and as low as 350 lbs/sq.ft. on others.

In the early 1950's the Drever Co. installed the roller pressure spray quenches, as part of continuous plate heat treating facilities in plate mills world wide. The continuous plate heat treating facility consisted of a roller hearth high heat furnace for austenitizing plates, usually at 1650 degrees F., a roller pressure spray quench, roller transfer cars, roller tables for air cooling normalized plates, a roller hearth tempering furnace, for temperatures between 750 degrees F. and 1300 degrees F., and a roller leveler all in line.

To support the spray quench was a 250,000 gallon reservoir, two pumps rated at 11,000 GPM, two 24" reverse flush Kinney type strainers, six on/off and six throttle valves, and an operating pulpit to control the system. At a later date a 200 ft. high, 1,000,000 gallon capacity water tower and additional pumps was added to ensure a more uniform water pressure to the quench. This water pumping capacity limited the length of the roller spray quench to 50 ft. To maintain the equivalent water volume and pressure for a longer quench would require additional pumping and elevated tank capacities.

The plate product quenched and tempered was the highly alloyed HY-80 and HY-100 armor plate for the U.S. Navy and the high strength commercial steel described in Hodge et al U.S. Pat. No. 2,586,042. The quenched and tempered tonnage heat treated amounted to 20% of the product, the balance being normalized carbon plate up to 3" thick, the weight capacity of the furnace rolls.

For some twenty plus years this facility was the state of the art operating profitably at plate manufacturing mills.

During this entire time period the most serious operating problem of the facility was the choking and blocking of the spray pipe orifices with foreign material. It caused plates to be quenched out-of-flat and failures to meet required mechanical properties.

The choking was gradual at different rates at random locations and not detectable. It created a constant changing non-uniform quench pattern. Total orifice blocking appeared spontaneously and generally favored the mid-width of the quench as the spray pipes were fed from both ends. The detrimental affect increased as the hardenability (alloy) decreased and the plate thickness increased.

A quality assurance problem exists with the tendency of the pipes producing a lower quench severity to the plate mid-width and official specified mechanical tests are taken from the plate one quarter width. This created the condition that the official physical test results did not always represent the mechanical strength of the entire plate.

Analysis of the foreign material showed it to be a combination of mill scale and algae from the make-up water.

To alleviate the choking and blocking problem the plate manufacturers resorted to replacing the carbon steel spray pipes with stainless steel, installing flush valves on each pipe, reaming the pipes with rotating wire brushes and removing the pipes for redrilling. These procedures gave only temporary relief. Water treatment was also tried unsuccessfully.

In the early 1960's, the high strength heat treat plate market had become highly competitive. Plate customers were demanding the less expensive high strength steels of leaner alloys and carbon steel grades. The roller spray quenches were unable to satisfy these demands.

This brought about efforts within the steel industry to improve the quenching effectiveness of the spray quenches. It was the general opinion that the platen fingers by contacting the plate prior to the water application created a non-uniform temperature within the plate and also shielded the plate from the sprays. It was also thought that increasing the water volume and pressure would solve the problem.

The two major plate manufacturers-U.S. Steel and Bethlehem, the quench manufacturer-Drever Co. and a large plate fabricator-Caterpillar Tractor Co. initiated research programs to improve the efficiency of the plate quenches.

In the early 1960's, the Bethlehem Steel Corp. identified several of the problems and enumerated them in a paper presented at a technical meeting of the American Iron and Steel Institute. This paper described the specific disadvantages of the platens and further claimed it was also impossible to uniformly quench a stationary plate in the roller spray quench.

The Bethlehem Steel Corp. solution was to eliminate the platens and quench plates moving continuously, or progressively, between top and bottom high pressure spray curtains and then thru a lower pressure spray section similar to the roller quench. Plates were held flat between top and bottom rolls. See Malloy et al U.S. Pat. No. 3,756,869.

The Drever Co. solution was to maintain flatness between top and bottom rolls and reciprocate the plate back and forth between the top and bottom sprays. See Safford et al U.S. Pat. No. 3,423,254.

An additional solution of the Drever Co. was to quench plates moving continuously first thru top and bottom high pressure sprays and then thru the top and bottom low pressure sprays similar to the roller quench. The top and bottom rolls were tired, or ribbed, to allow better water flow on the surfaces. See Safford et al U.S. Pat. No. 3,420,083.

Caterpillar Tractor Co. also adopted the tired top and bottom rolls and higher water volumes and reciprocating the plate during the quench. See Lenz U.S. Pat. No. 3,546,911.

The aforementioned patents eliminated the platen hold down system in favor of top and bottom rolls to maintain plate flatness but retained the top and bottom sprays.

The United States Steel Corp. conducted a much more extensive in depth study to evaluate the effectiveness of their roller spray quenches. They introduced the use of the "Quench Severity Test" capable of measuring severities as close as ⅛ inch apart on the plate. The test required a Jominy Test from each plate as tested, a Rockwell C hardness test from the plate mid-gauge per test, the thermal diffusivity of the steel and the use of "Russell's Heat Flow Tables for Plates and Slabs." The quench severities values are given in H values. H=1.00 being the value arbitrarily assigned to still water at 65 degrees F. and the historically established acceptable value for industrial plate heat treating.

Plates from the same heat were quenched on the three U.S. Steel Homestead Works plate roller spray quenches and on the Duquesne Works bar dip quench for comparison.

After being quenched the plates were tested for quench severity over the entire plate in areas under the platen fingers and in areas between the platen fingers as well as areas remote form the fingers. Brinell hardness tests were also taken in the same areas.

The results did show the platen fingers adversely affected the plate areas under the fingers. Of more metallurgical significance the results revealed the spray pattern responsible for the nonuniformity of the spray quench and the dip quench was superior to the spray quench in both quench severity and uniformity.

With the knowledge gained from their quench investigations, U.S. Steel adopted the practice of conducting periodic quench severity tests and adjusting the alloy content of their steels to compensate for low quench severity values. Low quench severity tests on their oldest No. 1 quench, installed in 1957, necessitated a complete overhaul in 1962 to remove foreign material build-up in spray pipes, operating valves, strainer screens, pipe headers and manifolds.

The Bethlehem Steel Corp. and the Drever Co. in a joint effort in 1966 designed and built at the Bethlehem Steel Burns Harbor plant, a roller quench that quenched plates moving continuously between upper and lower sprays. It consisted of a short high intensity curtain quench followed by a lower pressure quench section similar to the platen quench. Flatness was maintained between upper and lower rolls. The initial high intensity quench consisted of top and bottom water spray curtains rated at 100 psi and 260 GPM volume on each surface developed by high pressure pumps. This was followed by two high pressure spray pipes and a low pressure section, 50 ft. long, applying sprays at 25 GPM/sq ft. volume and 15 psi. on each surface supplied by the 200 ft. high water tank.

During the development phase of the continuous plate quenching process the U.S. Steel Corp. supplied different steel grades to be quenched experimentally on the Drever Co. pilot continuous quenching apparatus. U.S. Steel Corp. personnel observed the trials and evaluated the plates for flatness and quenching efficiency at their Homestead Works. The report of these trials, dated Feb. 12, 1965, shows the continuous plate heat treating process unsatisfactory in obtaining the desired quenching severity, quenching uniformity and plate flatness.

The Bethlehem/Drever quench, due to the addition of high pressure pumps, is a higher cost apparatus than the platen quenches. By 1971, the Drever Co. had installed 25 continuous quenches world wide, two of which were installed in U.S. Steel Corp. plants; one at the 160/210 inch plate mill at the Gary, Ind. Works and one at the 160 inch plate mill at Baytown, Tex. Works.

During the start up phase of these continuous quenches at both the U.S. Steel plants they failed to obtain any measure of plate flatness on any grade or thickness. Plate surface hardness readings showed unsatisfactory uniformity and hardness levels. After extensive trials under the direction of the Drever Co. personnel no improvement was made. The lighter gauge plates were severely buckled and the heavier plates were crowned across the plate width at one end dished at the other end.

U.S. Steel modified these two quenches by eliminating the high pressure sections and the top and bottom curtains and quenched plates when totally within the low pressure section. They also added time delay devices that delayed the application of water slightly to one of the surfaces with respect to the other to achieve plate flatness. See Lacy U.S. Pat. No. 4,148,673.

This U.S. Steel Corp. modification in 1972 became the state of the art. It differed from the original roller quench in that the plates were confined between the directly opposed rolls of top and bottom roller tables instead of top and bottom platen fingers and the addition of timing devices that delayed the application of water from either top or bottom sprays. Plate flatness was improved over that of the continuous quenches, but, it retained all of the disadvantages of the spray system. These quenches produced large tonnages profitably by the addition of sufficient alloy to the plate analysis to compensate for the nonuniformity and low severity of the spray quench.

An investigation was conducted on the Texas quench, on Aug. 25, 1981, to compare the water pressure on each individual spray pipe. The low pressure quench section contains 53 top and 53 bottom pipes. The pipes are fed from 3 top and 3 bottom manifolds on each side. All spray pipes were reamed by rotating wire brushes prior to the test. Readings were taken on every pipe during 3 quenches. The results showed a favorable pressure consistency for each pipe but a significant difference from pipe to pipe.

A review of the background information, as heretofore presented, and an analysis of the available technical information, reveals the specific causes of the roller spray quench limitations and shortcomings. The nonuniformity and poor quench severity values, plate flatness problems, spray pipe orifice choking and blocking, inordinate apparatus structure and high energy consumption are all directly related to the spray system. The nonuniformity of the spray system results from the spray pattern wherein the areas of the plate surface impinged by the rod like jet sprays cool faster than the plate surfaces in the gaps between the sprays. This is amplified when the gap areas of the top and bottom plate surfaces are directly opposite. The plate flatness problem results from the difficulties equating the cooling effect of the top and bottom sprays. The plate is cooled by two separate sprays diversely affected by gravity in which the top surface floods and the bottom sprays impinge the plate and fall away. This action creates unequal quenching uniformity and severity between the top and bottom plate surfaces. This is further complicated by the quench being divided lengthwise into three sections controlled by separate flow valves, by the random choking and blocking of the spray pipe orifices and the changes of water pressure with different water levels in the elevated water tank.

In retrospect, the reasons the plate and quench manufacturers never considered abandoning the spray quench system were primarily financial. The plate industry committed to the roller spray quench in the 1950's and the continuous plate heat treating lines operated at a profit for years. When the plate manufacturers encountered difficulties treating the leaner alloy plates in the 1960's all their efforts were made to improve the existing spray equipment. The U.S. Steel Corp. research study, showing the dip quench superior to the spray quench, was never published.

The continuous plate heat treating lines remained profitable because 80% of the plates heat treated were the air cooled normalized grades, by adding alloys to the quench and temper grades and the plate manufacturers tolerating the production delays caused by the blocking and choking of the spray pipe orifices.

The roller spray quench had no serious competitors but other plate quenches were developed for quenching plates on the rolling mill tables immediately after being controlled rolled. This came about after the development of the controlled rolling process which achieves a fine austenitic grain suitable for quenching.

A French company, USINOR in Dunkirk, developed the Rapid Accelerated Cooling, RAC, process in which the austenitic plate immediately after rolling is held flat between upper and lower rolls while traveling through a water tunnel. This process attempts total transformation and requires further tempering.

A Japanese company, Fukayame Works of Nippon Kokan, developed the On Line Accelerated Cooling, OLAC, process in which the plates immediately after rolling are cooled by laminar water flow on the top surface and water sprays on the bottom. The O.L.A.C. process does not attempt to produce the high strength steel grades which require a tempering heat treatment after quenching. The O.L.A.C. process partially quenches the carbon steel grades after controlled rolling to produce a bainite microstructure leaving the plate with sufficient retained heat to temper the bainite and aid in the plate leveling process. The purpose is to achieve the required physical properties in carbon steels with lower carbon content to improve the welding.

The overriding disadvantage of quenching plates on the rolling mill tables is the addition of a cumbersome operation with special requirements to the rolling mill which decreases rolling mill production.

OBJECTS AND ADVANTAGES

Accordingly:

It is the general object of my invention to water quench steel plates during their heat treating operation to produce:

(a) Flat plates
(b) Uniform mechanical properties throughout the entire plate
(c) Unmarked plates Compared to the prior art conventional plate quenches described in the BACKGROUND my invention has the following advantages.

(a) Flatter plates
(b) More uniform and severe water quench
(c) Substantially less quenching apparatus structure
(d) Substantially less energy to operate
(e) Lower alloy analysis required in the plates.
(f) Substantially less operating maintenance required
(g) Capable of using brine and quenching media agitation
(h) Capable of quenching longer plates than are now available
(i) Adaptable to quenching controlled rolled plates from rolling mill tables without disrupting the rolling mill operation
(j) All of the above equate to a substantial economic advantage

SUMMARY

The general idea of my claimed invention is a method and apparatus for quenching an austenitized steel plate by holding it in a vertical orientation and flat configuration between sets of directly opposed and reciprocating rolls and rapidly submerging it into a water bath for the object of producing a plate of commercially accepted flatness and desired mechanical properties throughout.

The superior uniformity and severity of this quenching method and simplicity of apparatus design has the advantage of producing flatter and longer plates of less alloy content having uniform mechanical properties throughout more economically and energy efficient than the horizontally oriented plate water spray quenching method of the conventional prior art roller quenches described in the BACKGROUND. This method of quenching has the advantage of being adaptable to the use of more severe quenching media such as brine and media agitation. This quenching method, being adaptable to quenching controlled rolled plates from rolling mill tables, creates many new plate processing possibilities.

DRAWINGS

Figures

In the drawings closely related figures show the same number but different alphabetic suffixes.

FIGS. 1 thru 5 relate to my preferred embodiment apparatus.

FIG. 1—Shows an isometric view of the apparatus.

FIG. 2—Shows a side view of the apparatus.

FIG. 3—Shows an isometric view of the apparatus in a horizontal position.

FIG. 4—Shows an isometric view of the apparatus in a vertical position.

FIG. 5—Shows a side view of the apparatus in a water bath.

FIGS. 6 thru 12 are related to my alternative embodiment apparatus.

FIG. 6—Shows an isometric view of the apparatus.

FIG. 7—Shows an isometric view of the plate lifting apparatus.

FIG. 8—Shows a side view of the apparatus.

FIG. 9—Shows an end view of the apparatus.

FIG. 10—Shows an end view of the apparatus in a water bath.

FIG. 11A—Shows an end view of the roller hearth furnace.

FIG. 11B—Shows plate closed lifting hook in horizontal position.

FIG. 11C—Shows side view of roller hearth furnace discharge table.

FIG. 11D—Shows plate closed lifting hook in vertical position.

FIG. 12A—Shows side view of car bottom furnace car bottom.

FIG. 12B—Shows plate open lifting hook in horizontal position.

FIG. 12C—Shows plate open lifting hook in lifting position.

FIG. 12D—Shows plate open lifting hook in vertical position.

DRAWINGS

Reference Numerals for Preferred Embodiment Apparatus

| FIGS. 1 thru 5. |
|---|
| 13. Roll table |
| 15. Roll table |
| 17. Rods |
| 19. Cylinders |
| 21. Space gap |
| 23. Plate confining roll |
| 25. Plate confining roll |
| 27. Motor |
| 29. Drive shaft |
| 31. Angle gear |
| 33. Worm screw |
| 35. Roll motor |
| 37. Edge roll |
| 39. Edge roll journal |
| 41. Slide bearing |
| 43. Lifting lugs |
| 68. Plate |
| 72. Roller hearth furnace |
| 110. Water bath |

DRAWINGS

Reference Numerals for Alternative Embodiment Apparatus

| FIGS. 6, 8, 9, & 10 |
|---|
| 20. Heavy steel bed plate |
| 22. Stationary roller table |
| 24. Movable roller table |
| 26. Stanchions |
| 28. Free turning rollers |

-continued

| FIGS. 6, 8, 9, & 10 |
|---|
| 30. Stanchion web areas |
| 32. Space between stanchions |
| 34. Movable table base plate |
| 36. Free turning wheels |
| 38. Rails |
| 40. Motor |
| 42. Drive shafts |
| 44. Angle gears |
| 46. Worm screws |
| 48. Guide plates |
| 50. Structural beam |
| 110. Water bath |

DRAWINGS

Reference Numerals for Plate Lifting Apparatus

| FIG. 7 |
|---|
| 60. Spreader bar. |
| 62. Crane lifting lugs. |
| 64. Lifting hook attachment lugs. |
| 66. Closed lifting hook. |
| 68. Plate. |

DRAWINGS

Reference Numerals for Plate Lifting Hooks

| FIGS. 11A, 11B, 11C, 11D, 12A, 12B, 12C, 12D. |
|---|
| 66. Closed lifting hook. |
| 68. Plate. |
| 72. Roller hearth furnace. |
| 74. Furnace discharge table. |
| 76. Discharge table rolls. |
| 78. Lifting hook support rack. |
| 80. Lifting hook eye. |
| 82. Semicircular inner surface. |
| 86. Furnace car bottom. |
| 88. Furnace stools. |
| 90. Space between stools. |
| 92. Open lifting hook. |
| 94. Lifting pin. |
| 96. Hook slot balance position. |
| 98. Hook slot. |
| 100. Hook long leg. |
| 102. Hook short leg. |
| 104. Sand seal. |
| 106. Hook gaff. |
| 108. Hook slot hoisting position. |

DETAILED DESCRIPTION

Preferred Embodiment

FIGS. 1 & 2

FIG. 1 shows an isometric view of my preferred embodiment quenching apparatus constructed in accordance to my claimed invention. The apparatus comprises two directly opposed roller tables 13 and 15. The tables are structurally connected by plunger type rods 17 sliding in cylinders 19 located on the four corners at a minimum of locations, of the apparatus. The electric motor 27 turns drive shafts 29 connected to angle gears 31 that turn worm screws 33 that adjust the spacing 21 between the roll tables 13 and 15 and the plate confining rolls 23 and 25 shown holding a plate 68. The plate confining rolls are driven by electric reversible motors 35. Free turning plate edge support rolls 37 with axes of rotation at right angles and between the plate confining rolls are located at the bottom, as shown, of the apparatus. The plate edge support rolls 37 have one roll journal 39 in a slide bearing 41. Apparatus lifting lugs 43 are located in accordance with the hoists of an overhead or floor gantry crane (not shown.)

| Reference numerals for FIGS. 1 & 2 |
|---|
| 13. Roll table. |
| 15. Roll table. |
| 17. Rods. |
| 19. Cylinders. |
| 21. Spacing gap. |
| 23. Confining rolls. |
| 25. Confining rolls. |
| 27. Motor. |
| 29. Drive shaft. |
| 31. Angle gears. |
| 33. Worm screw. |
| 35. Roll motor. |
| 37. Edge roll. |
| 39. Roll journal. |
| 41. Slide bearing. |
| 43. Lifting lugs. |
| 68. Plate. |

FIGS. 3, 4, & 5

FIG. 3 shows the quenching apparatus in a horizontal orientation after receiving an austenitized plate 68 from the roller hearth furnace 72. The apparatus is positioned directly above the water bath 110.

REFERENCE NUMBERS FOR FIGS. 3, 4, & 5

68. Plate
72. Roller hearth furnace
110. Water bath

OPERATION

Preferred Embodiment FIGS. 1 Thru 5

Figure 2:
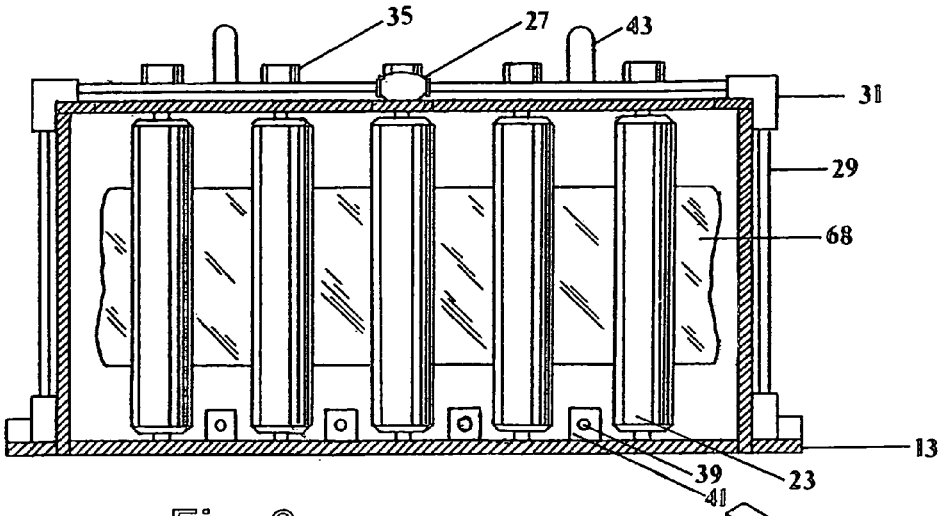
Figure 1:
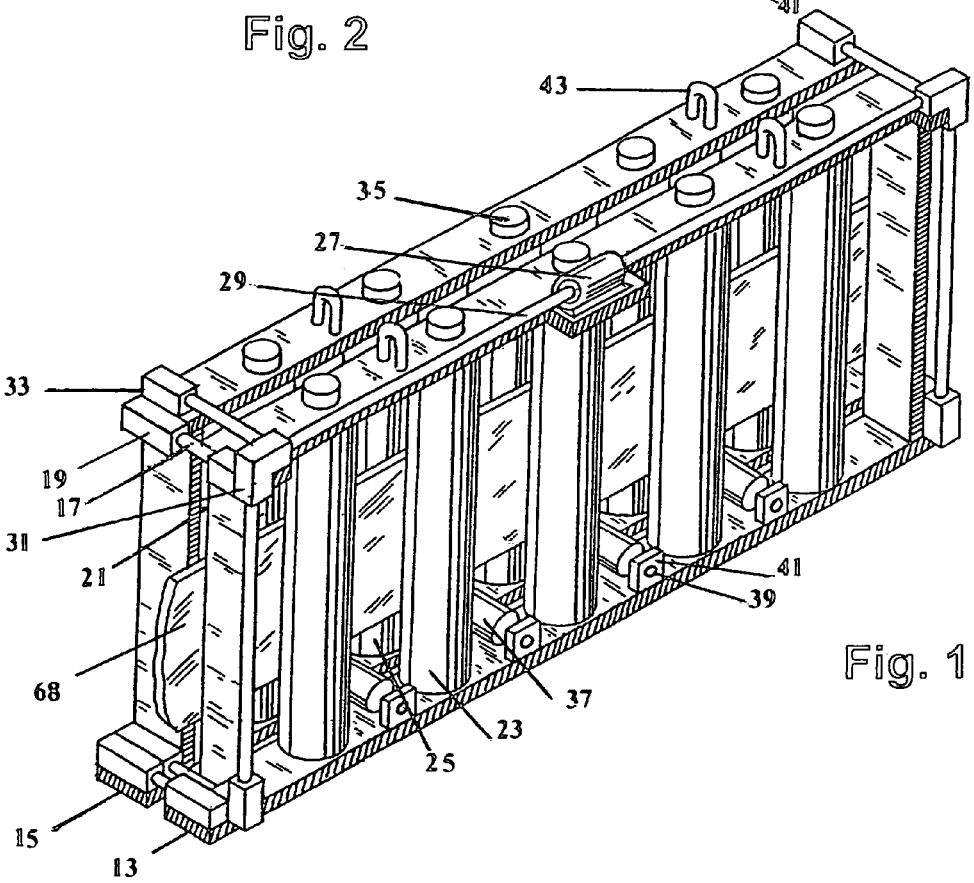
Figures 3, 4:
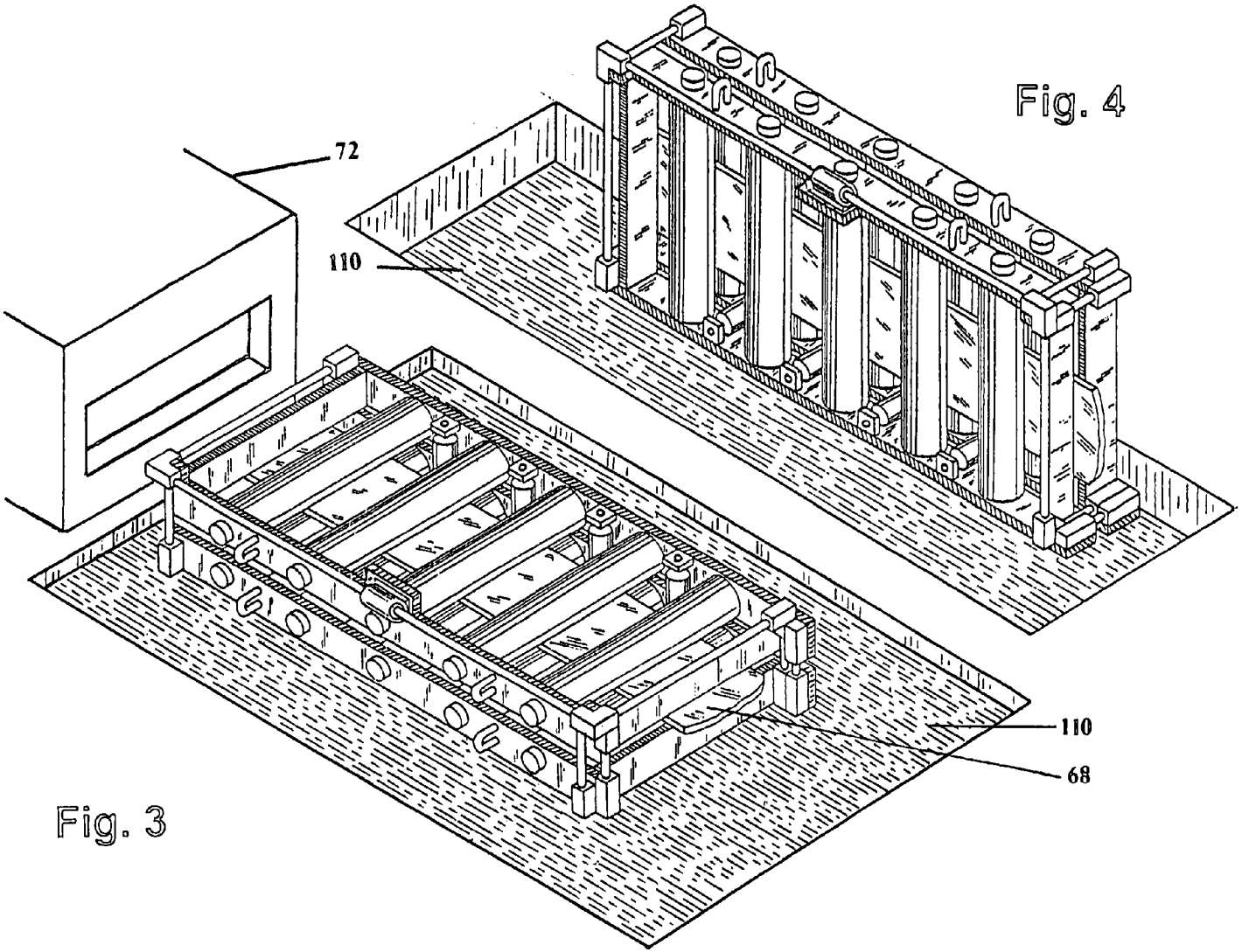
FIG. 4 shows the quenching apparatus after having been hoisted and rotated 90 degrees to a vertical orientation directly above the water bath 110.
Figure 5:
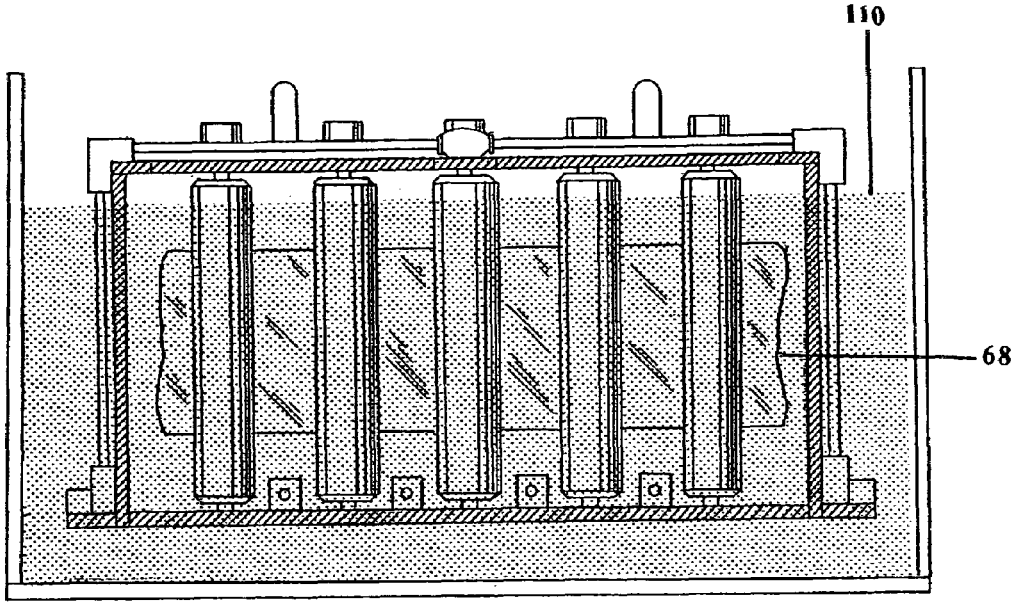
FIG. 5 shows the position of the quenching apparatus and totally submerged plate 68 in the water bath 110.

The quenching apparatus is designed to quench plates by the following method. Referring to FIG. 3, the apparatus is positioned relative to a roller hearth furnace 72 as shown to receive an austenitized plate 68 discharged from the furnace. Referring to FIG. 1, the spacing 21 between the table rolls 23 and 25 is adjusted in accordance with the thickness of the plate to be quenched so as to confine the plate closely and flat.

The adjustment is made by the electric motor 27 turning drive shafts 29, angle gears 31 and worm screw gears 33.

The top 13 and bottom 15 roll tables are held in alignment by the cylindrical rods 17 sliding in cylinders 19.

When the plate is heated to its austenitizing temperature, usually 1650/1660 degrees F., it is discharged at an approximate speed of 175 ft./min. between the synchronized speed rolls of the apparatus driven by the individual roll electric motors 35. When the plate is totally within the apparatus the plate travel is reversed and reciprocated in varying patterns keeping the plate within the apparatus.

At this time, the apparatus is hoisted by an overhead crane with hooks attached to the apparatus lifting lugs 43 rotating the apparatus 90 degrees to a vertical orientation as shown in FIG. 4. The apparatus is then rapidly lowered into a water bath 110 located either in line with the furnaces, as shown in FIG. 3, or adjacent, as shown in FIG. 4. The apparatus is lowered into the water bath 110 to the extent shown in FIG. 5 keeping the plate submerged and reciprocating during the quench period.

If the plate slips down in the apparatus it is supported by the free turning plate edge rolls 37. One journal 39 of the edge rolls is supported in a slide bearing 41 to allow for table roll space 21 adjustment.

The apparatus has a number of additional options for being rotated 90 degrees and submerged into a water bath. A floor gantry crane can perform the same function. A mechanical rig that rotates and submerges the apparatus into a water bath either in line with the furnace as shown in FIG. 3 or adjacent as shown in FIG. 4 would eliminate the need for a crane.

This method of quenching cools the entire plate surface uniformly and simultaneously at a maximum rate and achieves uniform metallurgical microstructures and mechanical properties throughout the plate and maintains plate flatness as confined by the reciprocating rolls. The method is adaptable to the use of brine and/or quench media agitation which enhances cooling severity.

This apparatus and quenching method avoids all of the metallurgical, operational, plate flatness and length limitations, inordinate structural apparatus and energy disadvantages of the horizontally oriented plate spray cooling quenches described in the BACKGROUND.

DRAWINGS

Detailed Description

Alternative Embodiment

Figure 6:
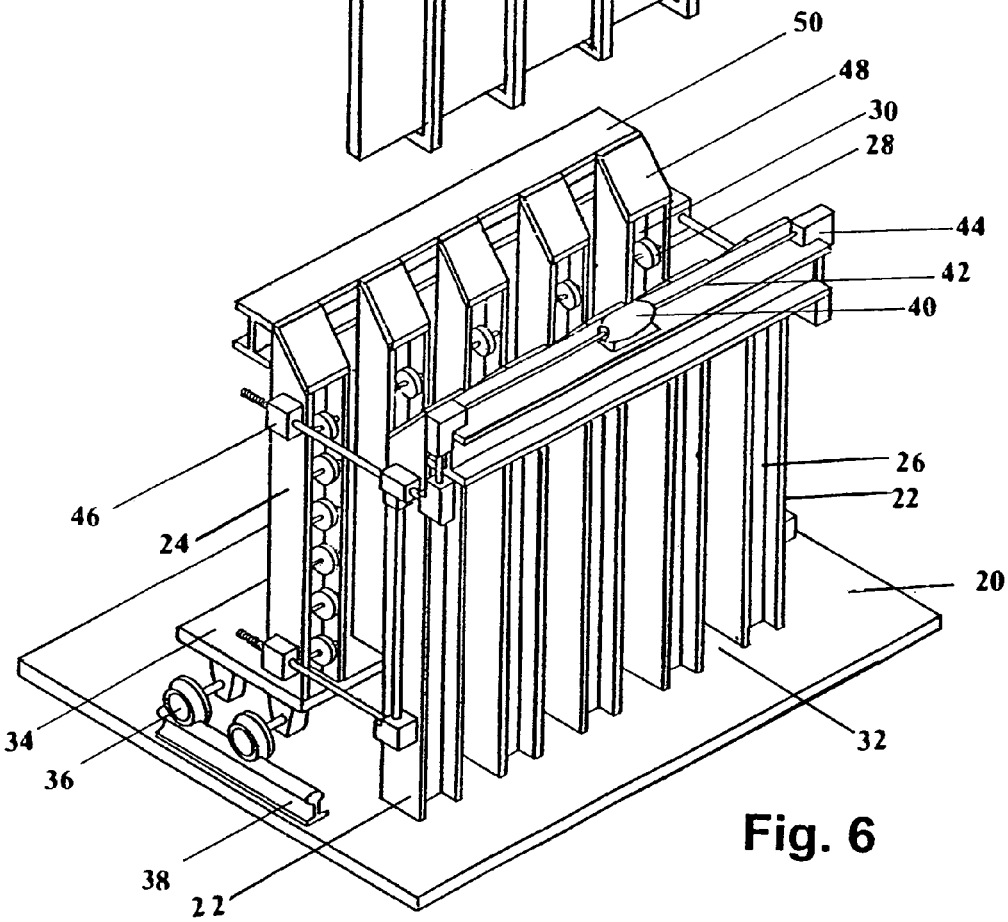

FIG. 6—The apparatus comprises two directly opposed roller tables.

A heavy steel bed plate 20 anchors a stationary roller table 22 and supports a movable roller table 24. The roller tables are constructed of a plurality of wide flange structural bean stanchions 26. A plurality of free turning rollers 28 are located in the web areas 30 of the stanchions. The stanchions are positioned horizontally and uniformly apart with predetermined spacing 32 between. The movable roller table 24 is anchored to a heavy base plate 34 supported on free turning wheels 36 riding on rails 38 anchored to the heavy bed plate 20. Movement of the movable roller table is powered by an electric motor 40 connected to drive shafts 42 connected to angle gears 44 turning worm screws 46. Guide plates 48 are atop the stanchions. The structural beam 50 anchors the stanchions.

| Reference Numerals for FIG. 6 |
|---|
| 20. Heavy steel bed plate |
| 22. Stationary roller table |
| 24. Movable roller table |
| 26. Stanchions |
| 28. Free turning rollers |
| 30. Stanchion web areas |
| 32. Spacing between stanchions |
| 34. Movable table base plate |
| 36. Free turning wheels |
| 38. Rails |
| 40. Electric motor |
| 42. Drive shafts |
| 44. Angle gears |
| 46. Worm screws |
| 48. Guide plates |
| 50. Structural beam |

Figure 7:
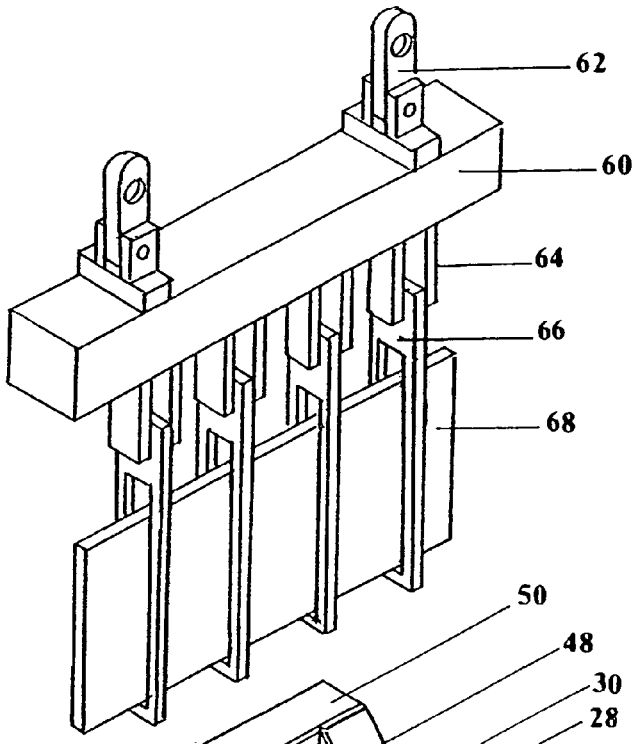

FIG. 7—The plate lifting apparatus comprises a spreader bar 60 having overhead crane (not shown) attachment lugs 62 positioned in accordance with the hoists of a typical single trolley two hoist shipping crane. The spreader bar plate lifting hook attachment lugs 64 are horizontally spaced to go between the stanchions of the quenching apparatus. Attached to the lugs 64 are plate closed lifting hooks 66 shown holding an austenitized plate 68 in a vertical position.

| Reference numerals for FIG. 7 |
|---|
| 60. Spreader bar |
| 62. Crane attachment lugs |
| 64. Lifting hook attachment lugs |
| 66. Plate closed lifting hook |
| 68. Austenitized plate |

Figure 8:
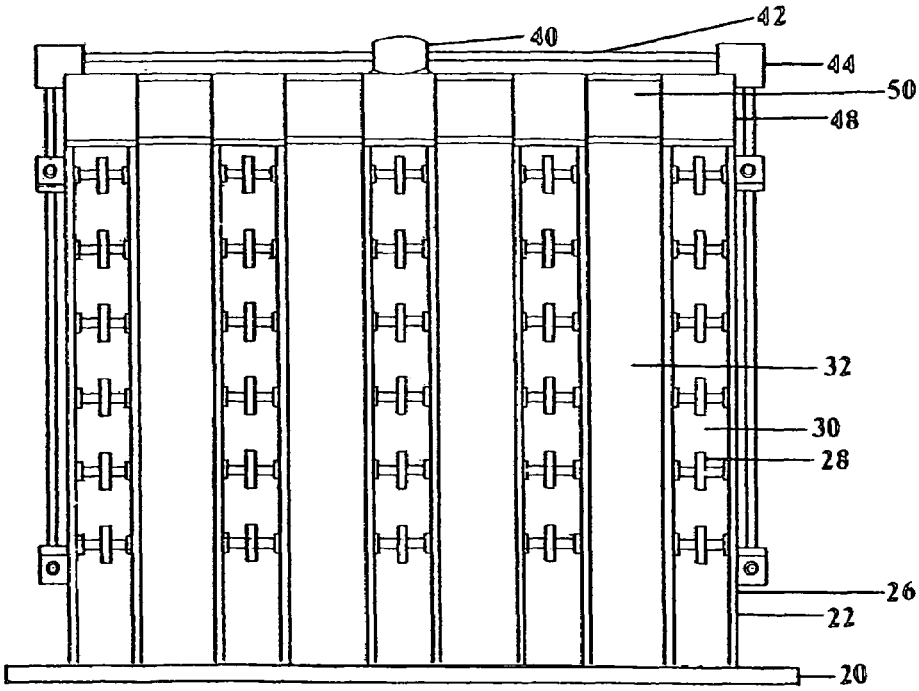

FIG. 8—Shows a side view of the roller side of the stationary roller bed 22. The roller bed is anchored to the heavy steel bed plate 20. Free turning rollers 28 are located in the web section 30 of the stanchions 26. The electric motor 40 is connected to drive shafts 42 connected to angle gears 44 connected to worm screws on the movable table (not shown.) Guide plates 48 and structural beam 50 are shown.

Figure 9:
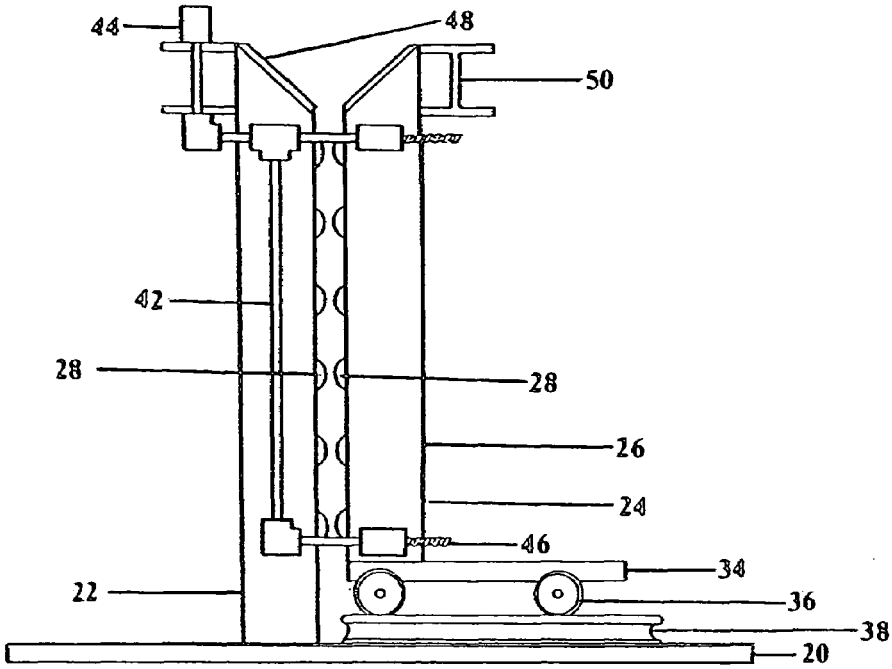

FIG. 9—Shows an end view of the apparatus. The stationary roller table 22 is anchored to the bed plate 20. The movable roller table 24 is anchored to the base plate 34 supported by free turning wheels 36 riding on rails 38 anchored to the bed plate 20. Free turning rollers 28 are located in the web sections of the stanchions 26. Worm screws 46 are rotated by drive shafts 42 thru angle gears 44 connected to the electric motor. (not shown.) Guide plates 48 and the structural beam 50 are shown.

Figure 10:
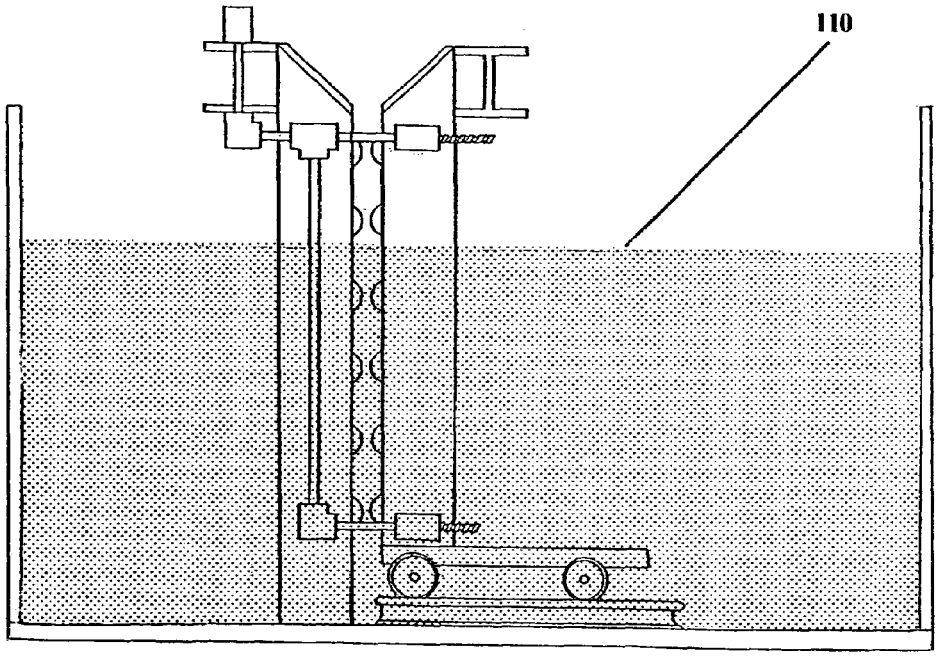

FIG. 10—Shows and end view of the apparatus in the water bath 110.

| Reference Numeral for FIGS. 8, 9, & 10. |
|---|
| 20. Heavy steel bed plate |
| 22. Stationary roller table |
| 24. Movable roller table |
| 26. Structural beam stanchions |
| 28. Free turning rollers |
| 30. Stanchion web sections |
| 32. Space between stanchions |

-continued

| Reference Numeral for FIGS. 8, 9, & 10. |
|---|
| 34. Movable table base plate |
| 36. Free turning wheels |
| 38. Rails |
| 40. Electric motor |
| 42. Drive shafts |
| 44. Angle gears |
| 46. Worm screws |
| 48. Guide plates |
| 50. Structural beam |

Figure 11A:
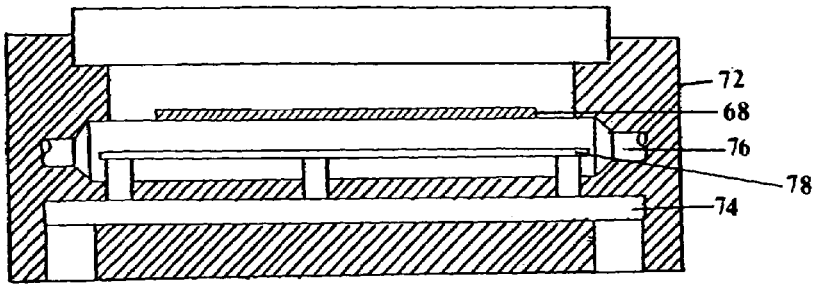

FIG. 11A—Shows an end view of the roller hearth furnace 72 and the furnace discharge table 74, discharge table rolls 76, lifting hook support rack 78 and the austenitized plate 68 resting on the table rolls.

Figure 11B:
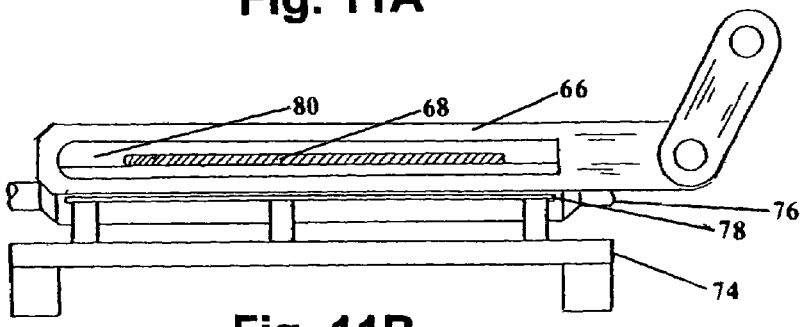

FIG. 11B—Shows a side view of the closed plate lifting hook 66 lying horizontally on the lifting hook support rack 78 enclosing the plate 68, resting on the table rolls 76, within the eye 80 of the lifting hook.

Figure 11C:
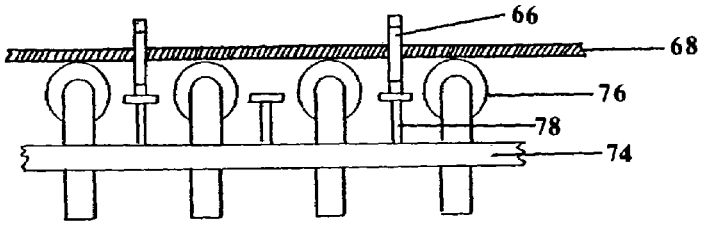

FIG. 11C—Shows a side view of the roller table 74 supporting the plate 68 on the table rolls 76 and an end view of the lifting hook 66 resting on the support rack 78 enclosing the plate 68.

Figure 11D:
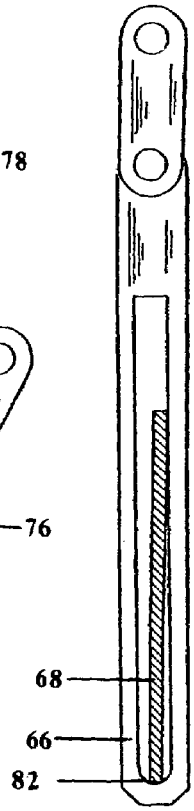

FIG. 11D—Shows a side view of the plate closed lifting hook 66 supporting the plate 68 in a vertical position resting on the semicircular inner surface 82 of the lifting hook.

REFERENCE NUMBERS FOR FIGS. 11A, 11B, 11C, & 11D

Figure 12A:
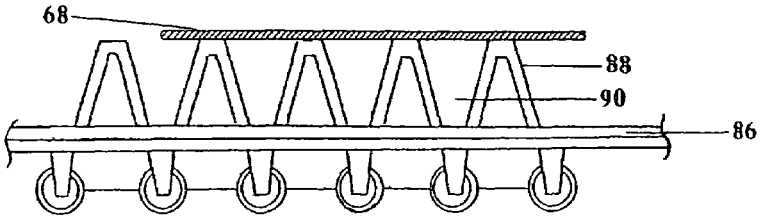

66. Closed lifting hook
68. Plate
72. Roller hearth-furnace
74. Furnace discharge table
76. Discharge table rolls
78. Lifting hook support rack
80. Lifting hook eye
82. Semicircular inner surface FIG. 12A—Shows a side view of a car bottom furnace car bottom 86, furnace stools 88, regulated spacing 90 between the stools supporting the austenitized plate 68.

Figure 12B:
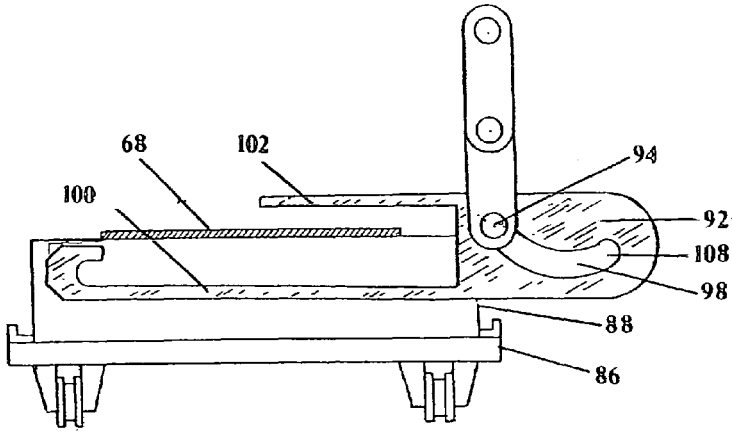

FIG. 12B—Shows a side view of the plate open lifting hook 92 supported horizontally by the lifting pin 94 at the balance position 96 of the hook slot 98 in the space 90 between the furnace stools 88 and the plate 68 between the long leg 100 and the short leg 102 of the lifting hook.

Figure 12D:
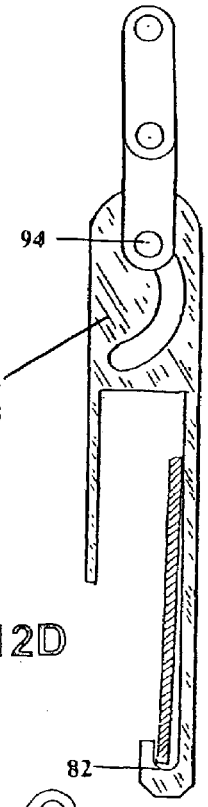
Figure 12C:
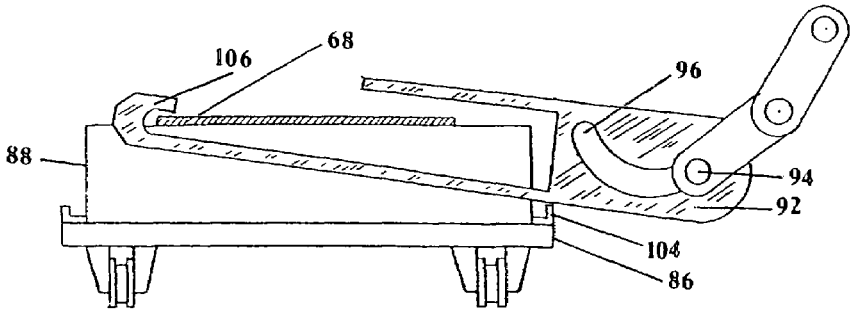

FIG. 12C—Shows a side view of the plate open lifting hook 92 supported at an angle on the car bottom sand seal 104 and the edge of the plate 68 within the gaff 106 of the hook long leg. The lifting pin 94 is at the hoisting position 108 of the hook slot 98.

FIG. 12D—Shows a side view of the plate open lifting hook 92 hoisted to a vertical position by the lifting pin 94 holding the plate 68 in a vertical position resting on the semicircular inner surface 82 of the hook gaff.

| Reference Numbers for FIGS. 12A, 12B, 12C, and 12D |
|---|
| 68. Plate |
| 82. Semicircular inner surface |
| 86. Furnace car bottom |
| 88. Furnace stools |
| 90. Space between stools |

-continued

| Reference Numbers for FIGS. 12A, 12B, 12C, and 12D |
|---|
| 92. Open lifting hook |
| 94. Lifting pin |
| 96. Hook slot balance position |
| 98. Hook slot |
| 100. Hook long leg |
| 102. Hook short leg |
| 104. Sand seal |
| 106. Hook gaff |
| 108. Hook slot hoisting position |

OPERATION

Alternative Embodiment FIGS. 6 Thru 12

According to my quenching method my apparatus is positioned in the quench water bath to the extent shown in FIG. 10. Referring to FIG. 9, I adjust the gap between the rollers 28 of the stationary roller table 22 and the movable roller table 24 in accordance with the thickness of the plate to be quenched. Referring to FIG. 6, I accomplish this by moving the movable roller table 24 by the electric motor 40 turning the drive shafts 42, angle gears 44 and worm screws 46. The movable roller table is anchored to the base plate 34 attached to free turning wheels 36 riding on rails 38 anchored to the heavy base plate 20.

Referring to FIGS. 11A Thru 11 D & 7.

In the case of quenching an austenitized plate 68 from the rolls 76 of the discharge table 74 of a roller hearth furnace 72, FIG. 11 A, or the table rolls of a rolling mill (not shown) I attach my closed plate lifting hooks 66 to the spreader bar 60. The spreader bar is attached by the lifting lugs 62 to the hoisting hooks of an overhead crane (not shown.)

I have the overhead crane position the lifting hooks on the lifting hook support racks 78 in a horizontal position as shown in FIG. 11B. When the plate 68 is heated throughout to the austenitic temperature, usually 1650/60 degrees F., I open the furnace door and discharge the plate, at an approximate speed of 175 ft./min. onto the synchronized speed rolls 76 of the discharge table 74. When the plate is totally on the rolls of the discharge table and within the eyes 80 of the lifting hooks, FIG. 11 C, I stop the rolls. At this time the overhead crane hoists the spreader bar, hooks and plate into a vertical orientation as shown in FIG. 11D, with the plate resting on the semicircular inner surface 82 of the lifting hook. The overhead crane, without delay, moves the plate directly over the quenching apparatus as shown in FIGS. 6 & 7.

Referring to FIGS. 12A Thru 12D and FIG. 7.

In the case of quenching an austenitized plate 68 from the furnace stools 88 of a car bottom furnace I attach my open plate lifting hooks 92 to the spreader bar as I did with the closed plate lifting hooks 66. As shown in FIG. 12B the lifting hook 92 is supported in a horizontal position at the balance point 96 of the hook slot 98 by the lifting pin 96. The overhead crane then positions the lifting hooks in the spaces 90 between the stools 88, FIG. 12 A. Referring to FIG. 12C the hooks are then raised and retracted to place the hook gaff 106 of the hook long leg 100 around the plate 68 edge and lowers the hook to rest on the car bottom sand seal 104. At this stage the hooks are supported by the plate and the sand seal and the lifting pin is lowered and slid in the slot 98 to the slot lifting position.

At this stage the crane hoists the hooks and the plate 68 into a vertical orientation, as shown in FIG. 12D, resting the plate on the semicircular inner surface 82 of the lifting hook. The semicircular shape provided a minimum of plate surface contact between plate and hook. The hook short leg prevents the plate escaping the hook. The overhead crane, without delay, moves the plate directly over the quenching apparatus as shown in FIGS. 6 & 7.

Referring to FIGS. 6 & 7

The methods for quenching plates held vertically by either the closed plate lifting hook 66 or the open plate lifting hook 92 are identical. Keeping in mind the apparatus is submerged in the water bath 110 to the extent shown in FIG. 10. The overhead crane rapidly lowers the plate 68 into the apparatus FIG. 6 in a continuous motion so as to be completely submerged. The lifting hooks are positioned to pass between the stanchions. The top two, or more, horizontal rows of rollers above the water surface shape the plate flat while still at temperature. The plate is held flat between the rollers below the water surface during the quenching period. To avoid uneven cooling at the plate/roller contact areas the plate is reciprocated up and down keeping the plate submerged. The guide plates 48 prevent warped plates from hanging-up on the stanchions. The plate is reciprocated until completely cooled.

My plate quenching method utilizes either my preferred or alternative embodiment quenching apparatus. Both apparatuses apply the same vertical plate dip quench techniques and achieve the same metallurgical and plate flatness results. A number of factors determine the apparatus best suited for a particular circumstance.

My preferred apparatus is best suited for a new plate heat treating facility and has the advantage of being a continuous operating process by not requiring lifting the austenitized plate from the tables.

My alternate apparatus is best suited for installation in existing plate heat treating facilities having either roller hearth and/or car bottom furnaces requiring lifting the austenitized plate from the roller hearth furnace discharge table or the car bottom furnace car bottom. This requires the use of lifting hooks designed for the particular furnace. The apparatus has a minimum of power driven moving parts and subsequent maintenance needs.

An additional advantage of the alternate embodiment quenching apparatus is it is the practical solution to producing quenched and tempered plates longer than the present 50 ft. limitation in demand by the bridge building industry. It is also the solution to producing quenched and tempered plates, including the over 50 ft. lengths, from controlled rolled plates lifted from rolling mill tables for quenching. This process eliminates the energy consumption of reheating plates in the austenitizing furnace as in conventional heat treating. It also eliminates the cumbersome quenching apparatuses on the mill tables as required by the RAC and OLAC processes and loss of rolling mill production which is the major objection of the rolling mill operators.

CONCLUSIONS

Ramifications

Advantages

In the quest by the steel industry to achieve plates of high strength and commercial flatness economically by the heat treating process a number of different quenching techniques and combinations thereof have been tried with varying degrees of success.

The reader is reminded this writing relates only to industrial size plates 3/16' thick and heavier.

The separate techniques fall into one of three general categories, i.e. the method of water application to the plate; the mechanical method of holding the plate flat; and the quenching media.

The purpose of the water application is to cool the entire plate surface uniformly and simultaneously at as severe a rate as possible.

The purpose of the mechanical equipment is to hold the plate flat with the least obstruction to the water application.

The purpose of brine solutions and media agitation is to enhance the cooling rate of the water.

A number of the separate quenching techniques are known, including the techniques described in U.S. Pat. Nos. 141,837; 3,420,083; 3,423,254; 3,546,911; 3,756,869 and 4,148,673.

A number of roller spray quenches have been installed throughout the world by the Drever Co., all of which spray quenched horizontally oriented plates.

My combination of plate quenching techniques differ from the quenching techniques of the prior art installed industrial plate quenches in the basic techniques of plate orientation and method of water application as well as the optional techniques of brine media and media agitation.

The justification for the efficiency of the dip quench is twofold. Prior to the acceptance of the roller spray quenches, plates were quenched while held horizontally and dip quenched into water baths. These plates exhibited microstructural uniformity but required extensive mechanical leveling.

The justification that steel plates quenched in a vertical orientation would retain their quenched shape more so than plates quenched in a horizontal orientation comes from production shop trials. Considering the fact that steel contracts on cooling except when passing thru the crystallographic phase change, usually above 1300 degrees F., the steel expands, making the plate shape control complicated. This necessitates that to retain the as-quenched plate shape that both plate surfaces be cooled identically as to uniformity and simultaneity. Guided by this premise the following experiments are cited.

Prior to the development of the roller spray quench, the present inventor dip quenched three full size armor plates held without restraint in a rack which showed considerable flatness improvement over plates dip quenched held horizontally. The idea was not adopted for other operational disadvantages.

After the installation of the roller spray quenches a major operating problem was the failure to consistently produce flat plates. The out-of-flat plate shapes fell into two categories i.e. edge or center buckles (waves) and crowning or dishing across the plate width. This was true with both the platen and roll hold-downs. The cause of the buckles was the choking or blocking of the spray pipe orifices creating nonuniform cooling. The condition was corrected by the flushing and/or reaming of the spray pipes. The cause of the dishing and crowning was the difference of cooling rates of the top and bottom plate surfaces. This condition was best improved by the time delay between water application to one of the plate surfaces. See Lacy U.S. Pat. No. 4,148,673.

The efforts made by the steel industry to improve the water quenching method in the heat treatment of high strength structural plates have all been directed toward achieving uniform martensitic microstructure and plate flatness with a minimum use of alloys.

In recent years, energy consumption has become a progressively important economic and environmental factor in industry. Dip quenching steel plates instead of spray quenching represents a large savings of electrical and natural gas energy. The spray system requires large amounts of electricity to produce the sprays. To quench a single plate in the spray quench requires an average of 90,000 gallons of water be pumped to an elevation of 200 ft. to the water tank. The superior uniformity and severity of the dip quench over that of the spray quench also represents a savings of costly alloys. The superior plate flatness produced in the dip quench over that of the spray quench represents a savings of electricity as well as natural gas. Plates quenched out-of-flat require either reheating to austenitizing temperature or excessive mechanical leveling.

My quenching method is not limited to the steel grades totally dependent upon microstructural transformation strengthening. My quenching method is particularly useful in quenching the HSLA (high strength low alloy) and austenitic stainless steel grades that require high degrees of uniformity when quenching from their solution heat treating phase.

Various changes within the invention may be made in the described apparatus embodiments. Austenitized plates could be lifted to a vertical position by dog hooks that clamp the plate edges but is considered unsafe and would heavily mark the edges. In the case of my preferred embodiment apparatus the plate confining rolls may be tired, helical tired or have other uneven surfaces. Such foregoing changes and modifications may be provided without departing from the spirit of this invention or scope of the appended claims.

To produce plates which have commercially acceptable flatness, as well as desired martensitic microstructure throughout, it is critical to cool both plate surfaces simultaneously, uniformly and identically as fast as possible with the use of water. It is also critical the plate be held flat in a vertical orientation and reciprocated during the quenching process. I avoid the use of quenching sprays as has been the practice in the prior art since such sprays cool the plate nonuniformly, worsen the flatness problem and create mixed microstructures. My method and apparatus are particularly useful for quenching relatively thin alloy steel plates (3/16 or 3/8 inch thick), where it is most difficult to produce plates of proper flatness. Nevertheless, my invention is not thus limited, but may be applied to plain carbon steel plates or to plates of greater thickness, to the high strength low alloy grades and the austenitic stainless steels.

I claim:

1. A method for heat treating steel plate, comprising the steps of:

heating a cold steel plate in a furnace adapted for heat treating steel plate to make a hot steel plate;

discharging the hot steel plate from the furnace;

capturing the hot steel plate in a plate-holding apparatus after the hot steel plate is discharged from the furnace;

providing a water bath adapted for quenching the hot steel plate;

hoisting and moving the plate-holding apparatus over the water bath, wherein the hot steel plate is held in an essentially vertical orientation while over the water bath;

quenching the hot steel plate by lowering it completely into the water bath while in the essentially vertical orientation to make a heat-treated steel plate; and holding the hot steel plate in the water bath as it becomes the heat-treated steel plate in a manner to ensure that the heat-treated steel plate is essentially flat.

2. The method of claim 1, wherein the plate-holding apparatus is a pair of opposing roller tables clamped together in which the hot steel plate is held tightly between the opposing roller tables for ensuring that the heat-treated steel plate is essentially flat.

3. The method of claim 2, further comprising moving the hot steel plate in a reciprocating motion while it is held tightly between the opposing roller tables and while the hot steel plate transforms into the heat-treated steel plate in the water bath.

4. The method of claim 1, wherein the plate-holding apparatus comprises a plurality of lifting hooks, wherein each lifting hook has an eye, and wherein the hot steel plate is received in the eye in each lifting hook.

5. The method of claim 4, wherein the step of holding the hot steel plate in the water bath as it becomes the heat-treated steel plate in a manner to ensure that the heat-treated steel plate is essentially flat is accomplished using a pair of opposing roller tables fixed inside the water bath, wherein one roller table is stationary and the other is movable.

6. The method of claim 5, further comprising moving the hot steel plate in a reciprocating motion while it is held tightly between the opposing roller tables and while the hot steel plate transforms into the heat-treated steel plate in the water bath.

7. A method for heat treating a metal plate, comprising the steps of:

heating a metal plate to an austenitizing temperature in a furnace, wherein the plate has a top planar surface and an opposing bottom planar surface;

passing the metal plate from the furnace into an apparatus adapted for holding the plate in a manner to ensure that the plate is flat;

hoisting the apparatus and the metal plate in a manner to ensure that the metal plate is in an essentially vertical position; and submerging the metal plate in a water bath while maintaining the metal plate in an essentially vertical position, wherein the apparatus and the submerging step are adapted such that adjacent portions of the top and bottom surfaces are cooled uniformly in order to provide desirable physical characteristics in the metal plate.

8. The method of claim 7, wherein the apparatus for holding the metal plate comprises a pair of opposing frames and a plurality of rollers disposed in each frame, and wherein the metal plate is held tightly been the rollers, further comprising rotating at least one roller in alternating clockwise and counterclockwise directions for introducing a corresponding reciprocating motion for the metal plate.

9. The method of claim 8, wherein the metal plate is submerged in the water bath rapidly.

10. The method of claim 9, wherein the reciprocating motion for the metal plate is continued while the metal plate is submerged in the water bath.

* * * * *